United States Patent [19]

Sholes, II

[11] 4,368,521

[45] Jan. 11, 1983

[54] METHOD AND APPARATUS FOR DRAGLINE TIGHTLINE PROTECTION

[75] Inventor: John T. Sholes, II, Marion, Ohio

[73] Assignee: Dresser Industries, Inc., Dallas, Tex.

[21] Appl. No.: 192,646

[22] Filed: Sep. 30, 1980

[51] Int. Cl.[3] ..... G06F 15/20; E02F 3/46

[52] U.S. Cl. ..... 364/506; 37/DIG. 1; 364/424; 364/508

[58] Field of Search ..... 364/506, 424, 508, 551; 37/116, 115, DIG. 1

[56] References Cited

U.S. PATENT DOCUMENTS

| | | | |
|---|---|---|---|
| 3,636,325 | 1/1972 | Chytil | 364/424 |
| 3,934,126 | 1/1976 | Zalesov et al. | 364/424 |
| 4,035,621 | 7/1977 | Kemp | 364/424 X |
| 4,156,317 | 5/1979 | Schmidt | 37/DIG. 1 X |

*Primary Examiner*—Edward J. Wise

*Attorney, Agent, or Firm*—Gerald L. Lett

[57] ABSTRACT

Method and Apparatus are described for effecting tightline protection in a dragline excavating machine or the like. The described technique uses optical shaft encoders to provide binary coded decimal inputs related to the amount of hoist and drag rope paid out to digital logic. The control algorithm for the digital logic considers both static and dynamic conditions to optimize the permissible operating range of the dragline. In the digital logic device, signals corresponding with the amount of rope paid out from the dragline hoist and drag drums are added and compared with predetermined constants to sense a tightline condition. If either a static or dynamic tightline condition is sensed, indications are provided and cause motion brakes to be set in the machine. The same data can be used to electronically indicate limits of bucket travel.

9 Claims, 17 Drawing Figures

METHOD AND APPARATUS FOR DRAGLINE TIGHTLINE PROTECTION

BACKGROUND OF THE INVENTION

This invention relates to method and apparatus for determining the existence of certain operating conditions in excavating machinery or the like on the basis of data related to the position of the machine's operated implement. More particularly, the invention relates to means and method for determining the onset of and preventing a tightline condition in a dragline excavating machine or the like.

A principal tool in surface mining operations is the large walking dragline which removes vast amounts of overburden material in order to expose valuable minerals to be mined. In order to enhance the efficiency of such machines, they have been made larger and larger in size and in their load-carrying capabilities or bucket capacities. Consequently, the control systems used on the machines have become increasingly sophisticated in order to improve dynamic response time and decrease digging cycle time. This has increased the workload on the operator and has probably made the operator more susceptible to error.

Due to their particular geometry, all draglines are inherently susceptible to a condition termed "tightlining". Such a condition is defined as being that condition where the amount of hoist and drag rope paid out creates a condition where the ropes become tight and the bucket is drawn toward the boom structure at an undesirable velocity. The latter condition is termed dynamic tightlining. A condition termed static tightlining can occur when the bucket is carried too close to the boom. A dragline becomes particularly vulnerable to static tightlining in mining operations where deep digging, selective overburden removal or unique mining plans or terrain require the operator to carry the bucket close to the boom to provide adequate working clearances.

In the case of dynamic tightlining, the bucket actually approaches the boom at a velocity such that collision with the boom will result if proper action to stop the bucket is not initiated within a minimum time dictated by the velocity and position of the bucket. A dragline bucket is controlled by two independent motions termed hoist and drag. The hoist and drag ropes, for whatever reason, may be commanded to travel in essentially opposite directions, which will produce a resultant bucket velocity directed toward the boom structure. If this situation were not controlled, the bucket and/or ropes would ultimately contact the boom structure and, remembering that the bucket is a sizable item, it can be expected that extensive damage will occur.

In the case of static tightlining, the operator, for any of the reasons discussed above, is generally caused to carry the bucket close to the boom making it very difficult for the operator to view the operation of the bucket and its proximity to the boom structure. When the bucket is being carried so close to the boom, any side-by-side movement can lead to contact with and subsequent damage to the boom structure. The lateral movement of the bucket does occur during acceleration and deceleration of the machine while swinging to dump due to the large inertia of the suspended bucket.

In either case, the damage is usually substantial and can only be repaired after taking a dragline out of service. The costs of repair and lost use of the dragline are monumental.

Electromechanical systems are presently available for sensing the onset of a tightline condition. Of necessity, such systems utilize wireropes, springs, turnbuckles, etc. and such mechanical components are highly subject to vibration and fatique. In the operating environment of a dragline, they will receive much of the latter. Under operating conditions, such electromechanical systems have been found to be self-destructive. They are subject to deterioration caused by vibration, shock and the elements. Moreover, no known electromechanical system is capable of sensing the onset of a dynamic tightline condition as described above. The known electromechanical systems require the use of wireropes attached to the boom structure in as close proximity as possible thereto without interfering with the digging operation. The position of this wirerope continually requires adjustment and is in danger of destruction. The electromechanical systems have relatively slow response times due to the fact that they must operate using spring constants and inertias and experience wirerope stretch.

It is, therefore, an object of this invention to provide method and apparatus for sensing the existence of certain operating conditions based on data related to the position of the machine's operating implement. More particularly, for sensing the onset of both static and dynamic tightline conditions and for providing protection against the consequences of such condition.

Another object of this invention is to provide method and apparatus for static and dynamic tightline protection which will not affect the performance capabilities and efficiency of the protected dragline.

A further object of this invention is to provide a method and apparatus for sensing and protecting from a tightline condition which provides a control response in the shortest possible time with the greatest possible degree of accuracy.

Still another object of this invention is to provide a method and apparatus for tightline sensing and protection which is capable of operating in any machine environment and is capable of operating with any size or type of such machine.

A further object of the invention is to provide a method and apparatus for tightline condition sensing and protection which is capable of operating in the harsh environment customarily experienced by excavating or mining machinery or the like in a reliable fashion and which is easily maintainable.

The foregoing and other objects are obtained in accordance with the invention in a method and apparatus for sensing and preventing a condition related to the position of the operated implement, such as a tightline condition in a dragline or the like. In order to derive the necessary data with which to compute the operating condition in question, the amounts of hoist and drag rope paid out are sensed. The sensed values of hoist and drag ropes paid out are added to produce a sum signal having a value proportional to the sum of the amount of the hoist and drag ropes paid out. In order to determine the existence of a static tightline condition, this sum is compared with a predetermined constant which is determined in accordance with machine geometry. If the result of that comparison is that the sum signal is less than the predetermined constant, machine operation is halted due to the existence of a static tightline condition.

In a second comparison, the aforementioned sum signal will produce an indication only if a velocity limit has been exceeded and the sum of the feet of rope off the drums is less than or equal to a predetermined constant. The constant being based on machine geometry and machinery time constants.

In addition, in an alternate form, the sum signal can be compared with predetermined constants to provide limit indications. A first comparison is made to provide the operator with an indication that the bucket is close to the boom point. Another limit indication occurs when the bucket has been lowered a predetermined distance. Both of the above comparisons are based on information with respect to hoist motion. The data regarding drag rope paid out is used for providing analogous limit indications.

BRIEF DESCRIPTION OF THE DRAWINGS

The principles of the invention will be best understood by reference to a description of alternative preferred embodiments given hereinbelow in conjunction with the drawings which are briefly described as follows.

DESCRIPTION OF THE PREFERRED EMBODIMENTS

Figure 1:
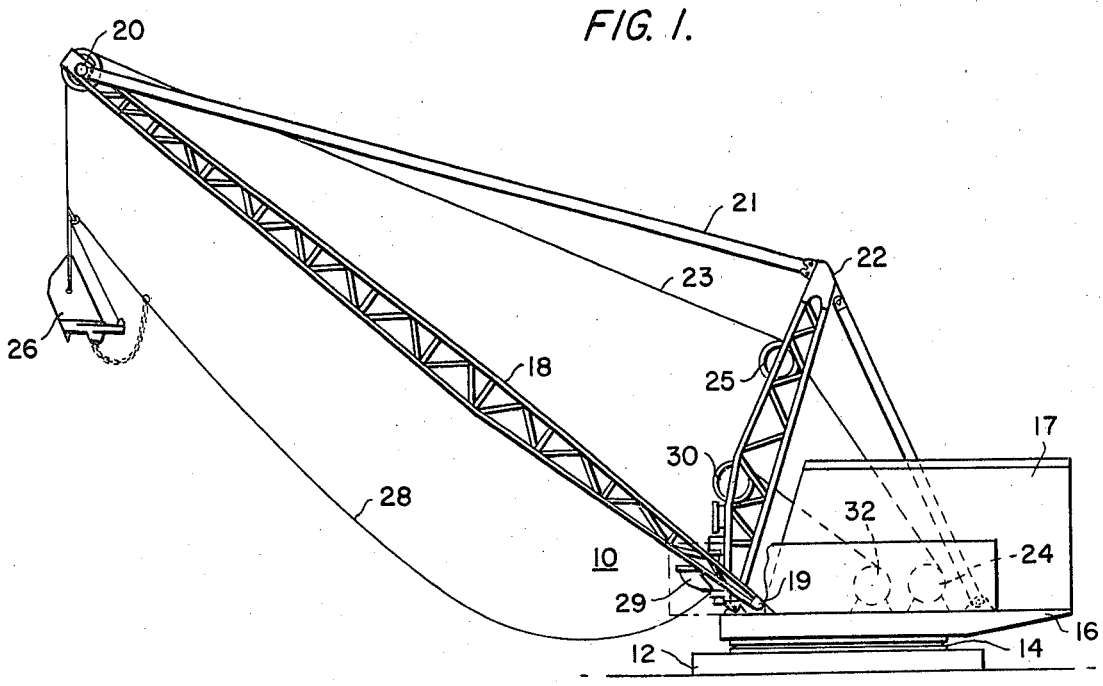
FIG. 1 is a side elevation of a typical dragline on which the invention is used.

In FIG. 1 is illustrated a typical dragline of the type to which the invention is applied. This dragline is only briefly described herein in that it is of conventional construction, and its construction and arrangement play no part in the invention. It is to be noted that the invention described herein is applicable to any type and design of dragline, or similar device, where similar problems can be encountered.

Excavator 10 of the dragline type is mounted upon a tub 12 which rests upon the ground. The tub carries a live roller circle type of rotating bearing 14 which, in turn, supports a main frame 16. Main frame or deck 16 has mounted thereon a house 18 which encloses the various machinery and ending drums for operating the excavator. A boom 18 is attached at its foot 19 by foot pins to the deck of the main frame. The boom point 20 is suspended at a proper angle and elevation by means of pendants 21 having their opposite ends connected to the top of a gantry 22. The front and rear legs of the gantry are attached to the main frame.

A hoist line 23 extends from a hoist drum 24 within the house upwardly through the roof of the house and over a deflecting sheave 25 carried by the front legs of the gantry. The hoist line continues from there over the boom point 20 and down to the implement operated by the machine, bucket 26. A drag line 28 is connected to the bucket and extends rearwardly under a fairlead sheave 29 and over a second fairlead sheave 30 and to a drag line drum 32 within the house. The particular arrangement of fairleads and sheaves, as well as the other rigging arrangements are, however, not critical to the invention.

The boom structure is supported at a fixed angle with respect to a horizontal reference line through the boom foot pins and parallel to the ground. This angle may vary between 25° and 40° depending upon the particular mine application. The position of the bucket 26 is controlled by the hoist and drag ropes, each attached to the bucket on one end and to their respective drums 24 and 32 on the other end as illustrated in FIG. 1. Bucket position is then determined by the amount of hoist and drag rope wound onto the respective drums. The sizes of the drums depending on the size of the machine and the application vary from between 130 and 300 centimeters in pitch diameter. Each drum is ultimately driven by a number of variable speed DC drive motors through gear reductions that are selected to optimize the performance of the dragline based on parameters established for each individual mining operation. (The drive mechanism is conventional and is not shown) The speed and direction of each drum is controlled independently by the operator who generally manipulates two master switch controllers simultaneously. Consequently, the amount of hoist and drag rope out, which determines the bucket position, and the velocity of each rope at any point and time is controlled by the operator through the speed regulated DC drive systems.

Figure 2:
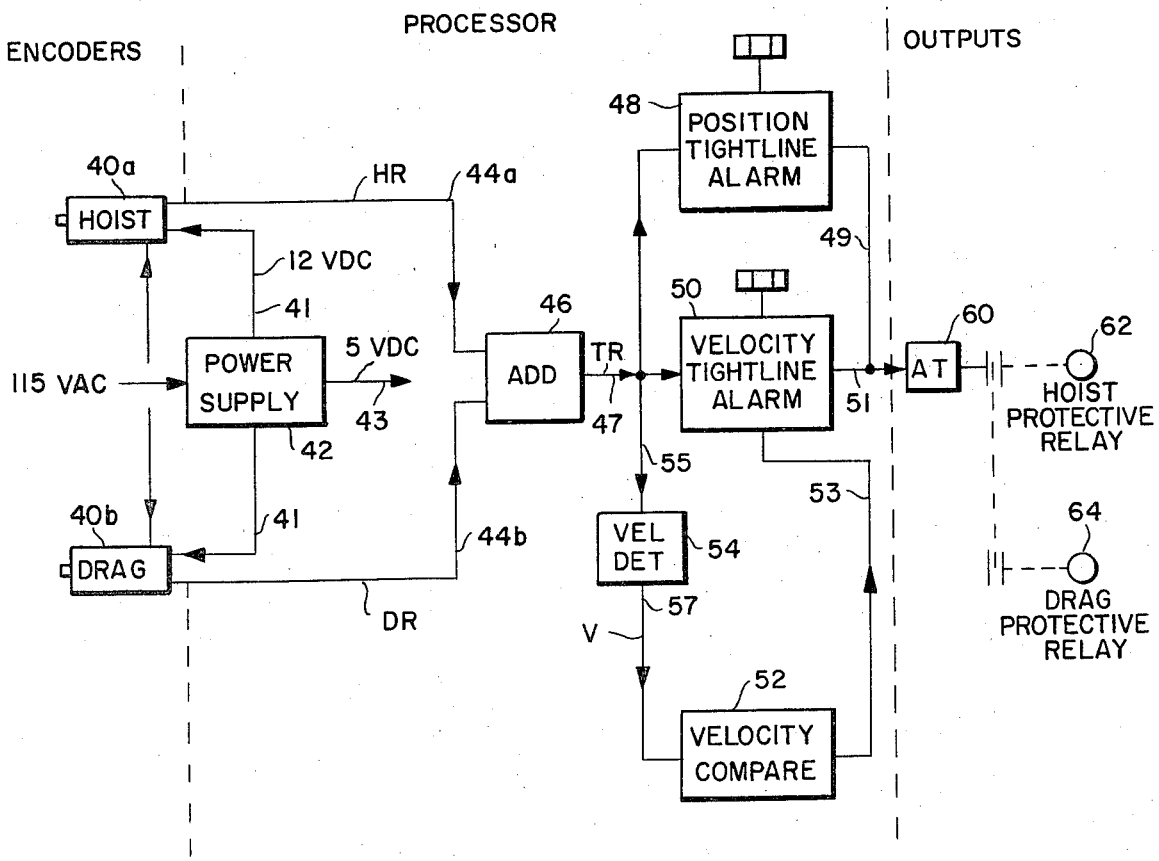
FIG. 2 is a block diagram of a preferred embodiment of the invention for sensing and protecting against tightline conditions.

FIG. 2 is a block-schematic diagram of a system constructed according to the principles of the invention for sensing and preventing a tightline condition in, for example, draglines of the type described hereinabove. The arrangement illustrated in this figure operates only to prevent a tightline condition, and it does not contain the features needed for providing limit indications as mentioned hereinabove. FIGS. 3 through 17 hereinbelow provide a detailed schematic diagram of a preferred form of the FIG. 2 embodiment. In addition, the preferred embodiment illustrated in FIGS. 3 through 17 includes the necessary circuitry for providing these limit indications.

The FIG. 2 embodiment is essentially divided into three main parts. These include the encoders necessary for sensing the data needed to make a tightline determination, a processor for utilizing this data to determine whether a tightline condition exists, and outputs for providing both indications of the presence or absence of a tightline condition and for halting the operation of the dragline should a tightline condition exist.

Encoders 40*a* and 40*b*, respectively, are direct coupled to the shafts of hoist and drag drums 24 and 32 by means of "zero adjustable couplings". The encoders sense the amount of mechanical hoist and drag drum shaft rotation and convert this value to a digital electronic output. The output signals are preferably in binary coded decimal (BCD) format. In view of the fact that the hoist and drag ropes are wrapped only in one layer around the drums, an indication of the amount of drum rotation is an accurate indication of the amount of hoist or drag rope paid out or taken in.

An example of an encoder which is used to perform this function is an optical BCD encoder manufactured by the Theta Instrument Corporation, Fairfield, N.J. and known as the DECITRAK (registered trademark) optical absolute shaft encoder. As is known, such encoders convert mechanical rotation to an electrical output in this case in the BCD format. Optical encoders are particularly desirable for use in this application in that they do not interfere with the rotation of the hoist and drag drums. Moreover, these are highly reliable devices, especially in the operating environment herein and, additionally, they are relatively more accurate than other forms of encoders.

Power supply 42 receives standard 115 volt alternating current, and converts it to two different direct current voltages values. A 12-volt DC signal is supplied on lines 41 to optical shaft encoders 40*a* and 40*b* for operation thereof. A 5-volt DC signal appears on line 43 for communication to the processor circuitry and the output circuity as is more clearly illustrated hereinbelow in connection with FIGS. 3 through 17.

The digital BCD outputs of encoders 40*a* and 40*b* which are labeled, respectively, as the HR and DR signals have values which are, respectively, directly related to the amount of hoist rope off the drum and the amount of drag rope off the drum. These signals are communicated, respectively, via lines 44*a* and 44*b* to a three-digit BCD full adder circuit 46. This circuit produces a digital signal TR which is directly related in value to the sum of the hoist rope off the drum and the amount of drag rope off the drum and is, therefore, directly related to the "total feet of rope off the drum". The output 47 of adder circuit 46 is connected to three different three-digit BCD comparator circuits 48, 50 and 52. As is more clearly illustrated hereinbelow, each comparator circuit is equipped with a three-digit thumb wheel switch input which allows manual selection of reference values to be operated on by the comparators.

Comparator 48 is a position tightline alarm comparator which will produce an output signal on line 49 any time the value of signal TR is less than or equal to the reference value supplied to this comparator via its thumb wheel switch. Comparator 50 is a velocity tightline alarm comparator which operates to compare three values. An output signal will appear at line 51 from comparator 50 when comparator 50 receives an enable signal on line 53 and the value of signal TR is less than or equal to the reference value supplied to this comparator by means of its thumb wheel input switch.

As will be described more fully hereinbelow, the least significant bit of signal TR is supplied from adder 46 via line 55 to a series of counter-timer circuits forming velocity detector 54 which processes signal TR to determine the velocity of operation of the hoist and drag drums or the velocity at which hoist and drag rope is being paid out. The resulting velocity signal is supplied via line 57 to velocity comparator 52 which produces an output signal on line 58 when the value of the velocity signal exceeds a reference value supplied to this comparator by means of its thumb wheel switch input. The output from comparator 52 forms the above-mentioned enable signal for comparator 50. Thus, comparator 52 produces an output signal any time the velocity of the drums or the velocity at which the rope is being paid out or brought in exceeds a predetermined reference value.

Should output signals appear on either of lines 49 or 51, output relay 60 will pick up and latch. The operation of this relay provides a positive indication of the existence of a tightline condition, and its operation can be used to operate other circuitry to bring the operation of the dragline to a halt.

For example, relay 60 can, in turn, operate a hoist protective relay 62 to cause an interrupt thereof, and it can have the same effect on a drag protective relay 64. Additionally, operation of relay 60 is used to actuate an alarm in the operator's cab.

When relays 62 and 64 drop out, they inhibit all reference to their respective motion power supplies, discharge their respective generator fields through discharge resistors and set their respective power brakes. Operation of the latter devices is conventional and is described in no greater detail herein. The tightline limit comparators 48 and 50 can be arranged to block out relays 62 and 64 until the operator pushes a button in the cab acknowledging the existence of the tightline condition. When the condition has been manually alleviated, the aforementioned references to the respective motion power supplies are no longer inhibited and normal control is resumed.

In setting the thumb wheel reference inputs to comparators 48, 50 and 52, the operator can utilize measures in distance (feet) and velocity (feet per second) so that no arbitrary, and perhaps incomprehensible, values are used. The tightline set points and velocity set points are adjusted by turning the thumb wheels. The zero points for both hoist and drag rope can be set exactly by adjusting the aforementioned "zero adjust" coupling on the optical encoders 40*a* and 40*b*. Readjustment of zero due to shortened rope, e.g., due to wear, or new rope can be accomplished by either changing the thumb wheel set point values to the comparators or by rezeroing the coupling.

Obviously, the system described hereinabove which provides static and dynamic tightline protection requires proper adjustment of the aforementioned three sets of thumb wheel digital input switches in order to ensure that a tightline condition is properly determined. The three settings establish the static and dynamic "envelopes" under the boom. In order to establish these settings, algorithms describing static and dynamic conditions must be defined.

In a static or dynamic tightline situation, the main concern is with the position of the bucket and specifically its distance from the nearest boom member. With the bucket in any given position, the boom, hoist rope and drag rope form a triangle. For purposes herein, a static tightline condition is defined as being when the sum of the amount of hoist rope and drag rope paid out is less than or equal to a constant ($T_S$). Remembering that the boom, hoist rope, and drag rope form a triangle, the law of cosines is used to produce an equation which defines the constant which defines the static tightline limit value:

$$T_S=[DR_{min}^2+BM^2-2(BM)(DR_{min}^2-BD_{min}^2)^{\frac{1}{2}}]^{\frac{1}{2}}+DR_{min}. \quad (1)$$

$$T_S=[HR_{min}^2+BM^2-2(BM)(HR_{min}^2-BD_{min}^2)^{\frac{1}{2}}]^{\frac{1}{2}}+HR_{min} \quad (2)$$

where:

$HR_{min}$=minimum hoist rope out;

$DR_{min}$=minimum drag rope out;

$BD_{min}$=minimum distance bucket to boom and

BM=boom length.

Equation 1 defines this value with the bucket at the drag-in limit, and equation 2 describes the condition with the bucket at the hoist limit. In determining which of these two values to use, the larger one is selected.

The dynamic tightline condition involves rope speeds and resulting bucket velocity. The bucket velocity is expressed in the following:

$$V_B=[(V_D \cos(\theta_B-\theta_D)+V_H \cos(\theta_B-\theta_H-90°))^2+(V_D \sin(\theta_B-\theta_D)+V_H \sin(\theta_B-\theta_H-90°))^2]^{\frac{1}{2}} \quad (3)$$

where $V_D$=drag rope line speed $V_H$=hoist rope line speed $\theta_H$=angle of the hoist rope $\theta_D$=angle of the drag rope $\theta_B$=angle of the boom The velocity tightline limit setting establishes the dynamic tightline envelope and is determined by examining the bucket velocity and drive system and machinery response time.

It is to be remembered that when it is attempted to shut down the dragline machinery, a finite time is required to bring the system to rest due to system inertias and drive system regulator response times. These times ($t_{SR}$) can be predicted based on machinery specifications. Utilizing this information, equation 1 hereinabove can be adjusted for system response time and bucket velocity to produce the following value ($T_D$) for the dynamic tightline limit setting.

$$T_D=[DR_{min}^2+BM^2-2(BM)(DR_{min}^2-V_B^2t_{SR}^2)^{\frac{1}{2}}]^{\frac{1}{2}}+DR_{min}. \quad (4)$$

or, $$T_D[HR_{min}^2+BM^2-2(BM)(HR_{min}^2-V_B^2t_{SR}^2)^{\frac{1}{2}}]^{\frac{1}{2}}+HR_{min}. \quad (5)$$

Equation 3 defines this constant at the drag-in limit, and equation 4 defines the constant for the hoist limit. The larger of the two values will be used for setting the apparatus described herein.

The velocity limit effectively recalibrates the static limit and shifts the static envelope away from the boom to compensate for total system response time if the bucket is approaching the static limit at a rate which is greater than or equal to a constant established by machinery specifications. Thus, the algorithm for the dynamic tightline velocity enable set point ($T_{DE}$) is the following:

$$T_{DE}=(d/dt)(HR+DR) \quad (6)$$

FIGS. 3 through 17 constitute a detailed schematic diagram of the entire system illustrated in FIG. 2. However, these figures contain additional features in that circuitry is illustrated for hoist and drag limit indicating functions. These circuits provide the necessary logic to establish limit signals which may be utilized by the machine operator to determine when certain predetermined hoist and drag limits have been reached, beyond which it would be undesirable to operate the machine.

Figure 3:
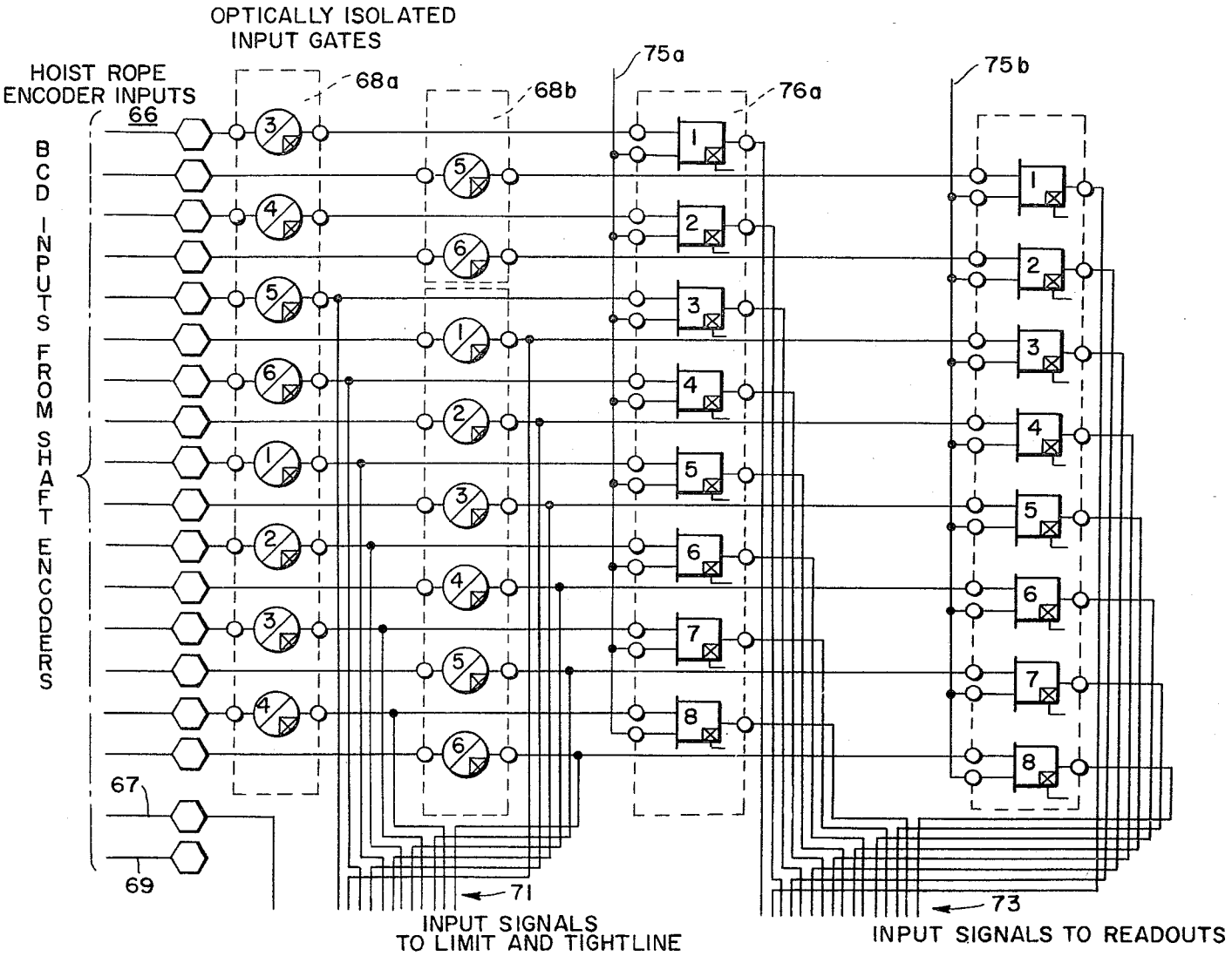
FIG. 3 is a detailed schematic diagram of a hoist rope input signal circuit for the FIG. 2 embodiment.

FIG. 3 is a detailed schematic diagram of a preferred form of input signal circuits for receiving the BCD input signals from optical shaft encoder 40a. These are the BCD signals which relate to the amount of hoist line paid out. These signals are received on lines 66. Line 67 receives the 5-volt DC signal from power supply 42. Line 69 is a DC common line.

The BCD signals are communicated to optically isolated input gates 68a and 68b. Gate circuits 68a and 68b are type NL-308L integrated logic circuits manufactured by the Westinghouse Electric Corporation.

The lines 71 communicate the isolator-conditioned BCD signals from these gates to adder 46 in a manner to be described more fully hereinbelow. Lines 73 communicate the BCD signals from the hoist drum encoder to indicator circuitry which is also described more fully below. Lines 75a and 75b receive inhibit signals used to select the mode of the indicators when the circuit is used with common digital indicators. Essentially, the gates 68a and 68b provide isolation of the processor circuitry from the encoders.

The BCD signals are communicated from gates 68 to AND gate circuits 76a and 76b. These circuits formed from a Westinghouse type module having eight AND circuits, each of which have two inputs and each of which provide true and not outputs. These AND gates allow selection of the input signals applied to the readouts or indicators used to indicate the amount of rope paid out from the hoist drum.

Figure 4:
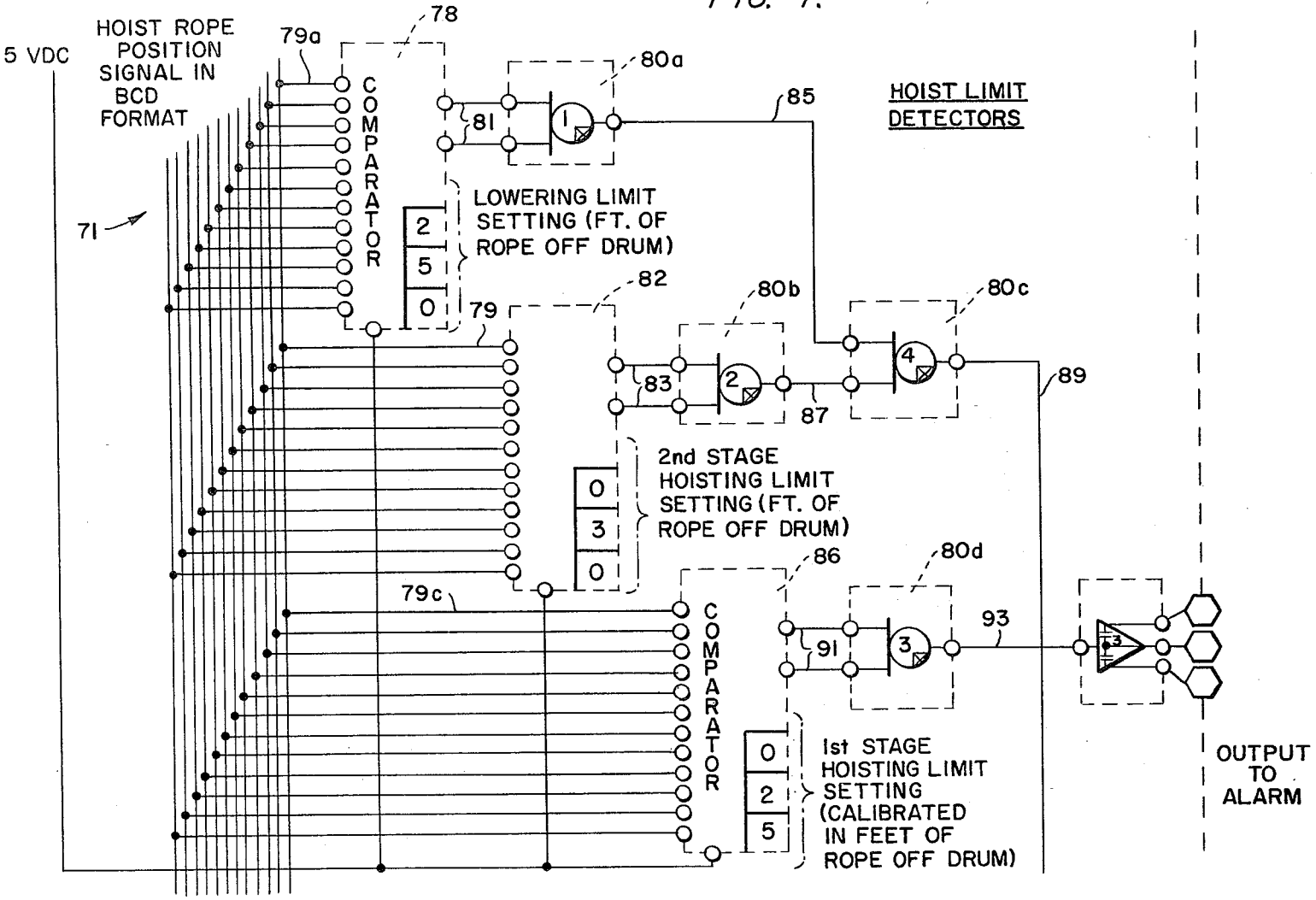
FIG. 4 is a detailed schematic diagram of a hoist limit detector circuit utilized with the FIG. 3 embodiment and which is an alternative feature.

FIG. 4 is a detailed schematic diagram of one aspect of the additional feature added to this detailed description of the circuitry. The circuitry illustrated herein provides hoisting and lowering limit indications to an operator based on the BCD position signal information received from optical encoder 40a.

In FIG. 4, the hoist rope BCD input signals appear on lines 71 (FIG. 3). These signals are communicated to a comparator 78 which is a Westinghouse type NL366 12-bit magnitude comparator which is capable of comparing two 12-bit numbers to provide one of three outputs of less than, greater than, or equal. Comparator 78 is equipped with a three-digit thumb wheel switch which provides one of the two digital inputs to be compared.

The thumb wheel switch input to comparator 78 is designed to provide a lowering limit setting for the hoist rope in a given amount of rope off the drum. Thus, this setting can simply be in an amount of rope off the drum.

The two outputs 81 from comparator 78 are supplied to two of eight inputs to an OR gate 80. OR gate 80 made up of portions 80*a–d* is formed from a Westinghouse type NL341L logic OR having true and not outputs.

Similarly, the hoist rope BCD signals are supplied via lines 79*b* to one of the inputs of a comparator 82. Comparator 82 is likewise formed from a Westinghouse type NL366 circuit. The thumb wheel inputs to comparator 82 can be adjusted to establish a second-stage hoist limit setting in an amount of rope off the drum. This second-stage hoist limit is designed to establish a limit at which the bucket is dangerously close to the boom point. This limit might be used to automatically remove reference and bring the motion of the bucket to a rest immediately. The outputs 83 from comparator 82 are supplied to corresponding inputs of portion 80*b* of OR gate 80.

The output 85 from OR gate 80*a* and the output 87 from OR gate 80*b* are supplied to corresponding inputs of portion 80*c* of OR gate 80. The OR gate output therefrom appears on line 89. Therefore, when either a lowering limit or a second-stage hoisting limit is exceeded, an output signal appears on line 89.

The hoist rope BCD signals on lines 71 also are coupled via lines 79*c* to comparator 86. Again, comparator 86 is a Westinghouse type NL366 circuit. The thumb wheel reference input to comparator 86 supplies a reference signal corresponding with a first-stage hoisting limit setting. Again, this thumb wheel setting can be calibrated in an amount of rope off the drum.

The first-stage hoist limit provides the operator with an alarm warning when the bucket is reaching a position which is considered too close to the boom point. This limit will be at a point which is lower than the second-stage hoisting limit or at which there will be a somewhat greater amount of rope off the hoist drum.

The output signals appearing on lines 91 from comparator 86 are supplied to corresponding inputs at portion 80*d* or OR gate 80. The output from this OR gate is supplied via line 93 to a quad relay contact output 90. The latter is formed from a Westinghouse type NL 326LTTL circuit which converts TTL levels to isolated contacts and provides corresponding LED visual outputs when no contacts are closed. The latter circuit actuates the aforementioned alarm.

Figure 5:
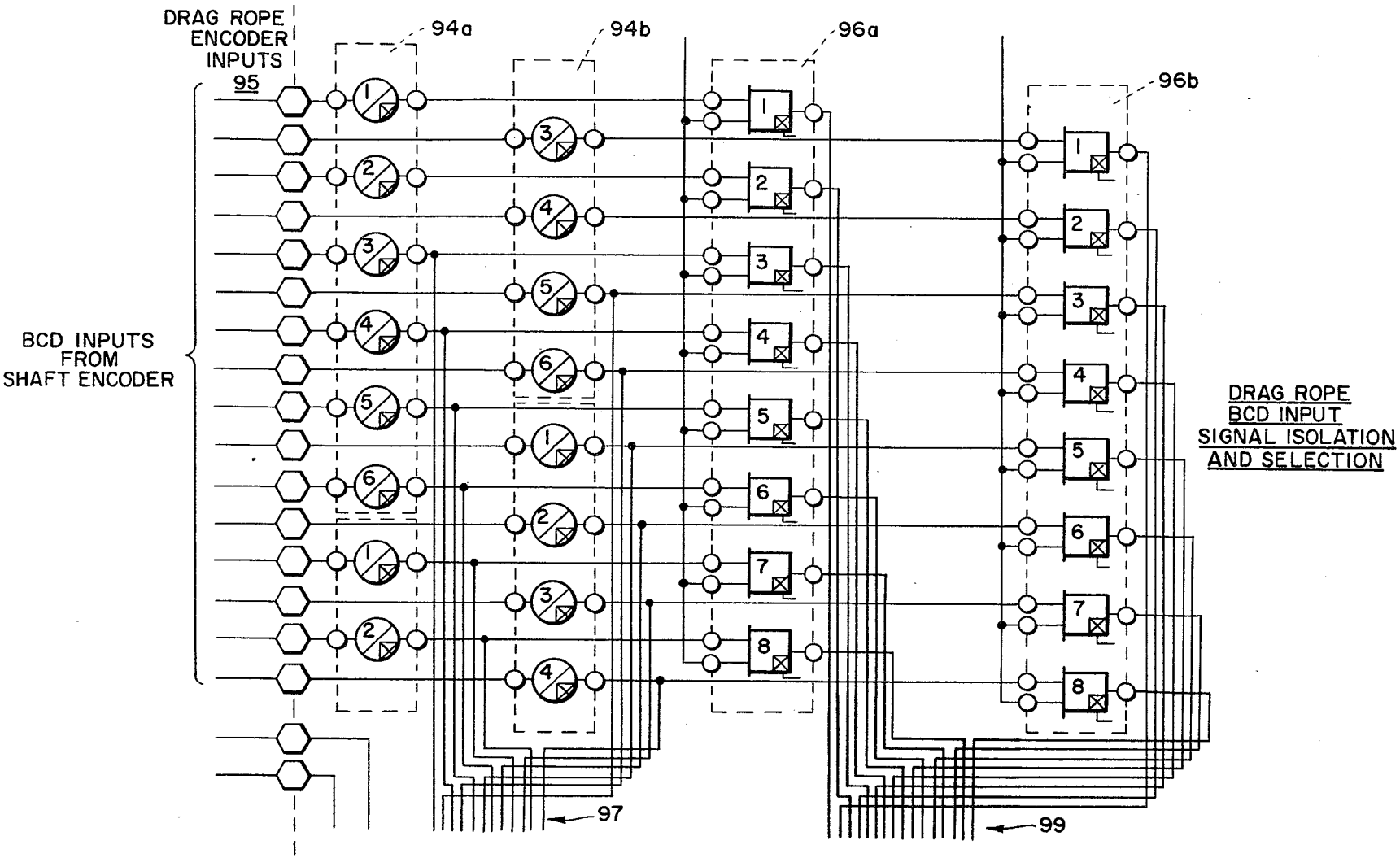
FIG. 5 is a detailed schematic diagram of a drag rope input signal circuit in the FIG. 2 embodiment.

FIG. 5 is a detailed schematic diagram of the drag rope BCD input signal isolation and selection circuit. Except for the fact that this circuit receives and processes drag rope signals, it is identical in construction to the hoist rope input circuit described hereinabove in connection with FIG. 3.

Correspondingly, the drag rope input BCD signals are supplied on line 95 to input isolation circuits 94*a* and 94*b* which are likewise Westinghouse type NL308L circuits for converting the input signals to TTL logic levels. These levels appear on lines 97 for supply to the limit and tightline detector circuits described below.

The outputs from gates 94*a* and 94*b* are additionally supplied to AND gate circuits 96*a* and 96*b* which are again Westinghouse type NL342L circuits. The outputs from these circuits appearing on lines 99 are supplied to readouts for a purpose to be described hereinbelow.

Figure 6:
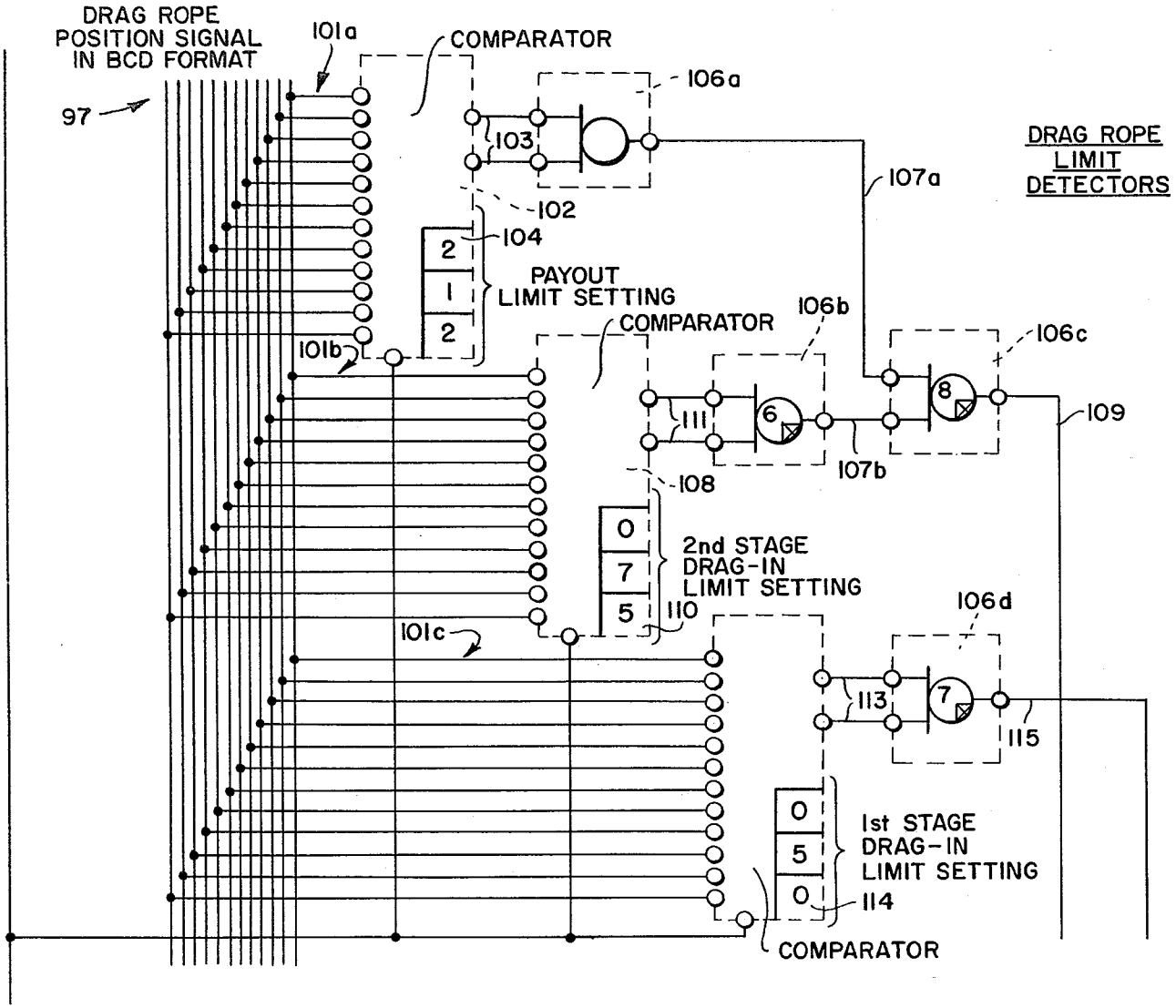
FIG. 6 is a detailed schematic diagram of a drag rope limit detector circuit which alternatively can be used with the FIG. 2 embodiment.

FIG. 6 is a drag rope limit detector which like the hoist rope limit detector in FIG. 4 can be supplied as an optional feature.

The drag rope BCD signals on lines 97 are coupled via lines 101*a* to comparator 102 which is a Westinghouse type NL366 comparator circuit. The thumb wheel reference inputs 104 supply an input reference signal which corresponds with a drag rope pay out limit. The thumb wheels are calibrated in feet of rope off the drum.

An OR gate circuit 106 formed also from a Westinghouse type NL341L circuit is, for purposes herein, divided into portions 106*a*, 106*b*, 106*c* and 106*d*.

The outputs from comparator 102 appearing on lines 103 are coupled to corresponding inputs of OR gate circuit 106*a*.

The drag rope BCD input signals on lines 97 are also coupled via lines 101*b* to an input of comparator 108 which is also a Westinghouse type NL366 comparator circuit. Thumb wheel reference input switches 110 on comparator 108 are for setting a limit corresponding with a second-stage drag-in limit setting.

The output appearing on lines 111 from comparator 108 are coupled to corresponding inputs of OR gates 106*b*. The outputs from OR gates 106*a* and 106*b* appearing on lines 107*a* and 107*b*, respectively, are coupled to corresponding inputs of OR gate 106*c*, the output from which appears on line 109.

The drag rope BCD input signals on lines 97 are also coupled via lines 101*c* to a comparator 112 which is similarly a Westinghouse type NL366 comparator circuit. The thumb wheel reference input switches 114 to comparator 112 supply a reference input signal which corresponds to a first-stage drag-in limit setting. Again, this setting is calibrated in feet of rope off the drum, but this reference will be a greater number of feet of rope off the drum than the second-stage drag-in limit setting used in connection with comparator 108. The output from comparator 112 is supplied on lines 113 to corresponding inputs of OR gates 106*d*, the output of which appears on line 115 and will be supplied for alarm indicating purposes in connection with circuitry to be described below.

Figure 7:
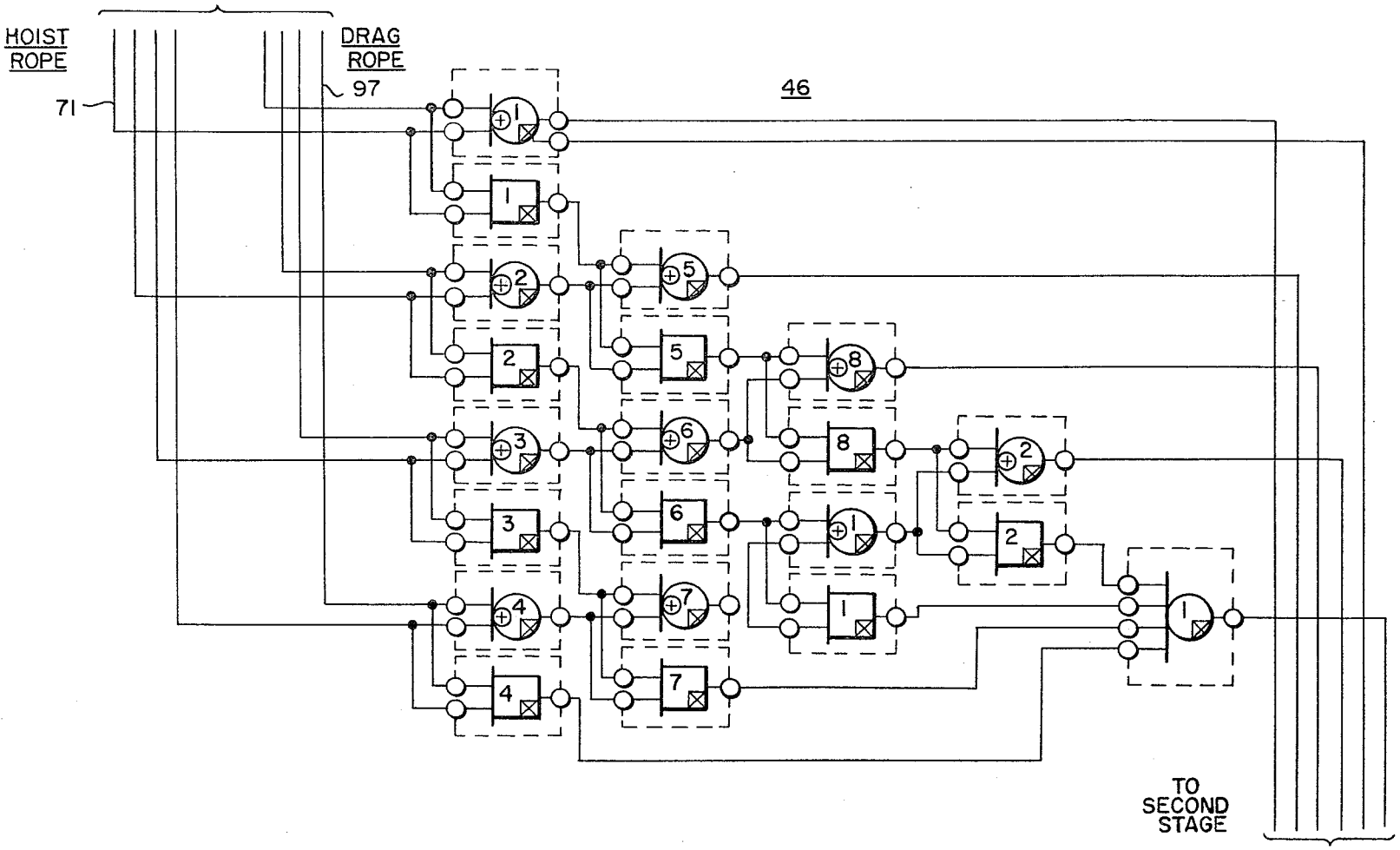
FIG. 7 is a detailed schematic diagram of a first stage, least significant digit portion of the adder circuit in the FIG. 2 embodiment.
Figure 8:
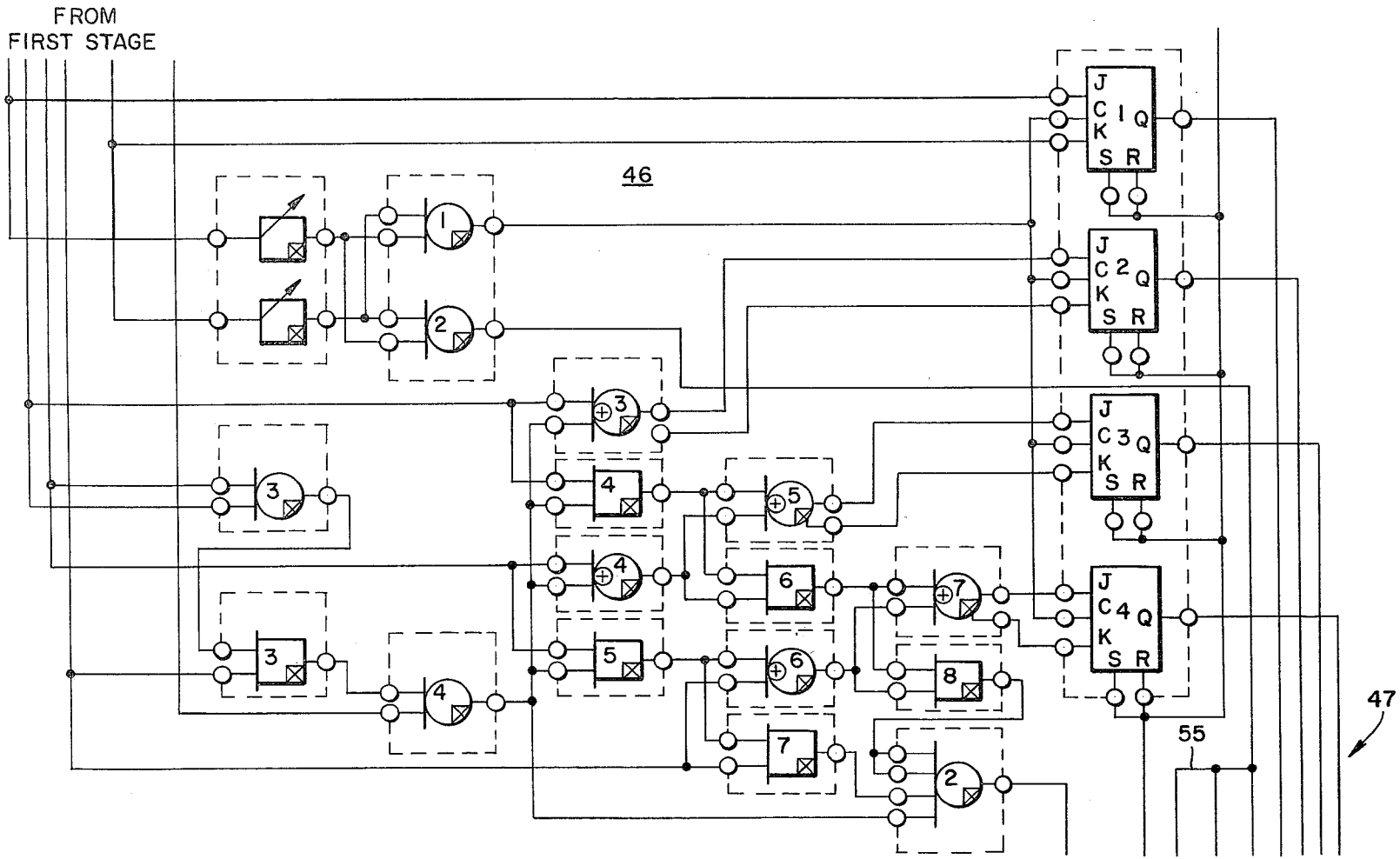
FIG. 8 is a detailed schematic diagram of the second stage, least significant digit portion of the adder circuit in the FIG. 2 embodiment.
Figure 9:
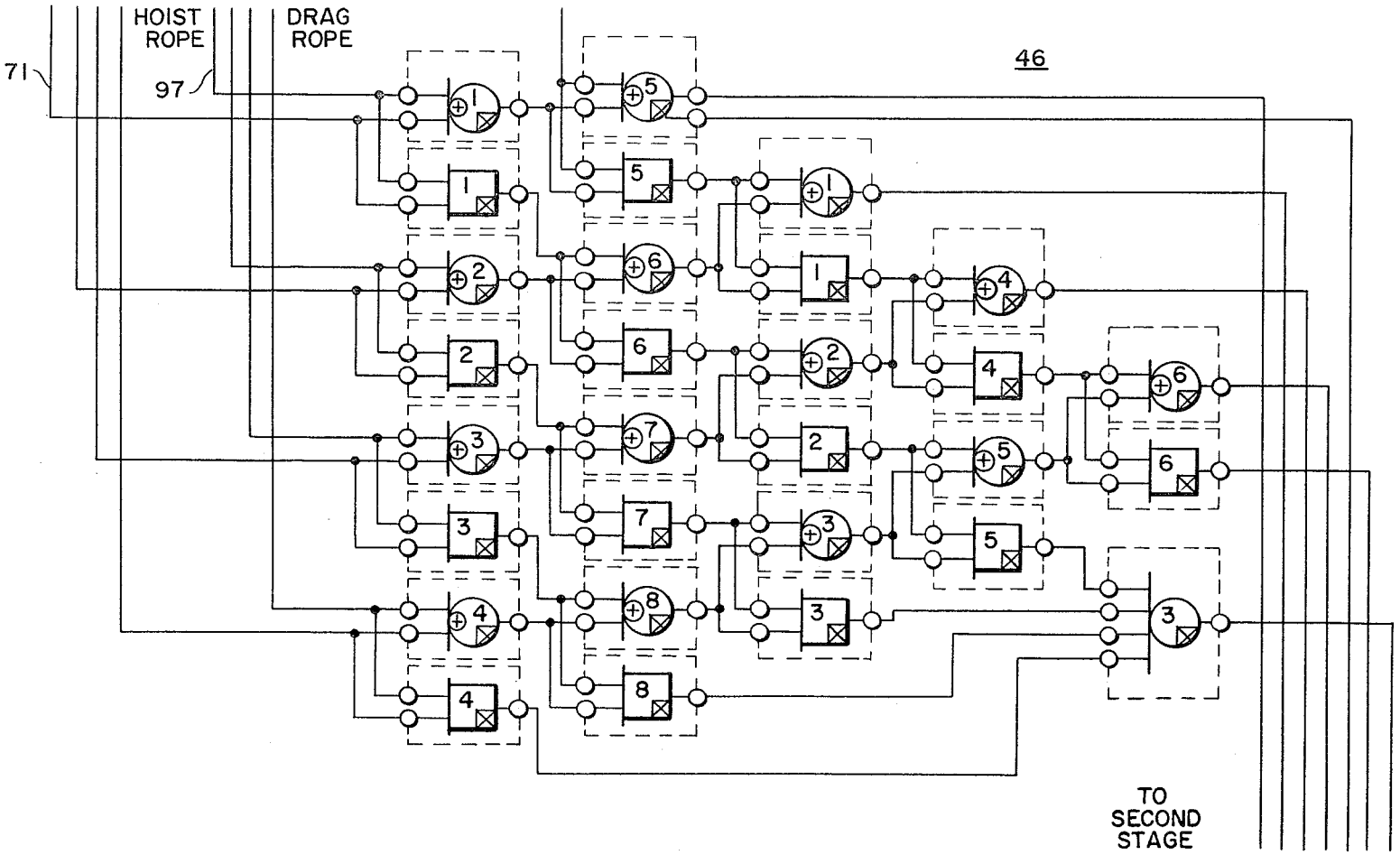
FIG. 9 is a detailed schematic diagram of a first-stage, second-digit portion of the adder circuit in the FIG. 2 embodiment.
Figure 10:
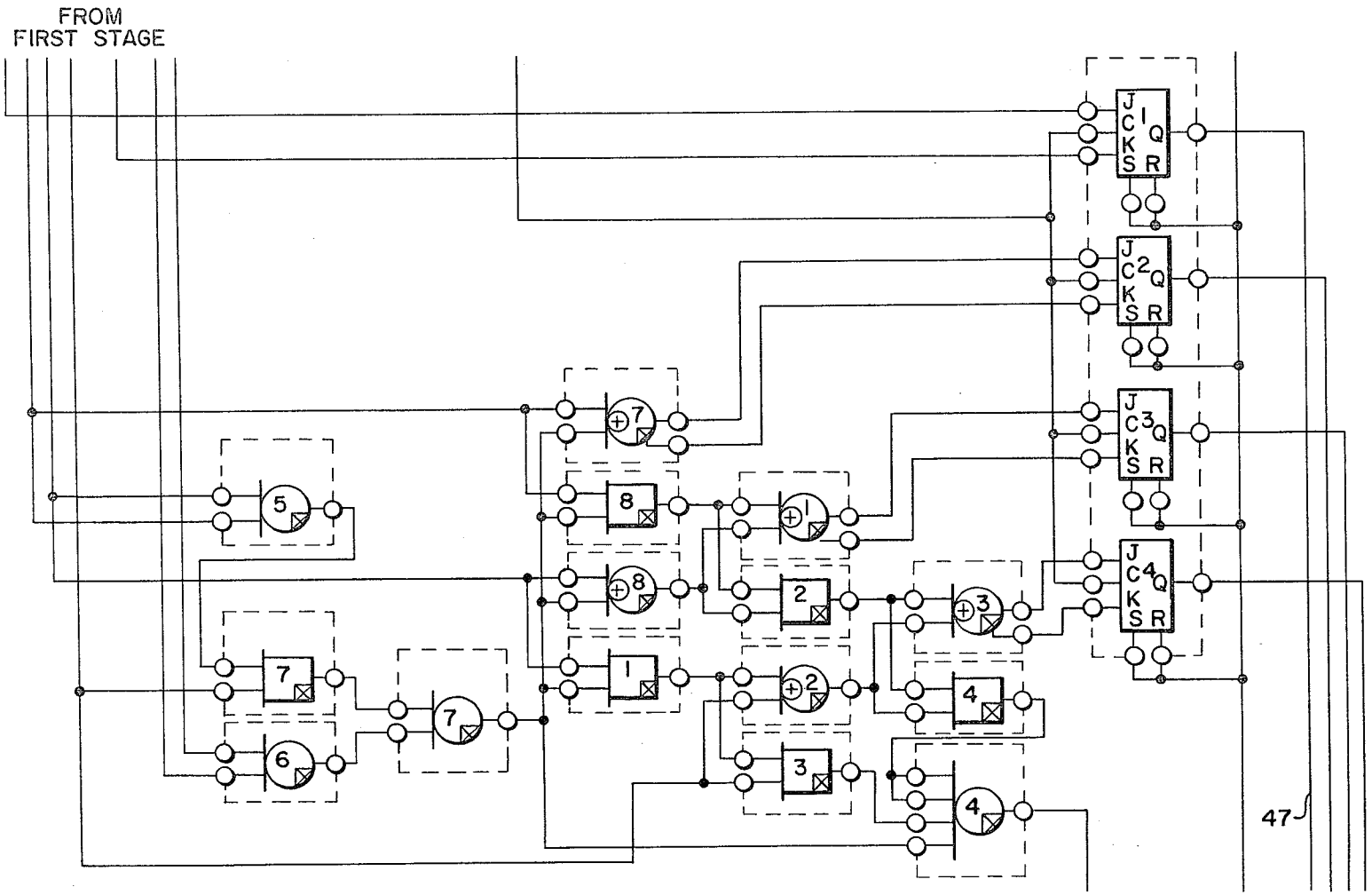
FIG. 10 is a detailed schematic diagram of the second-stage, second-digit portion of the adder circuit in the FIG. 2 embodiment.
Figure 11:
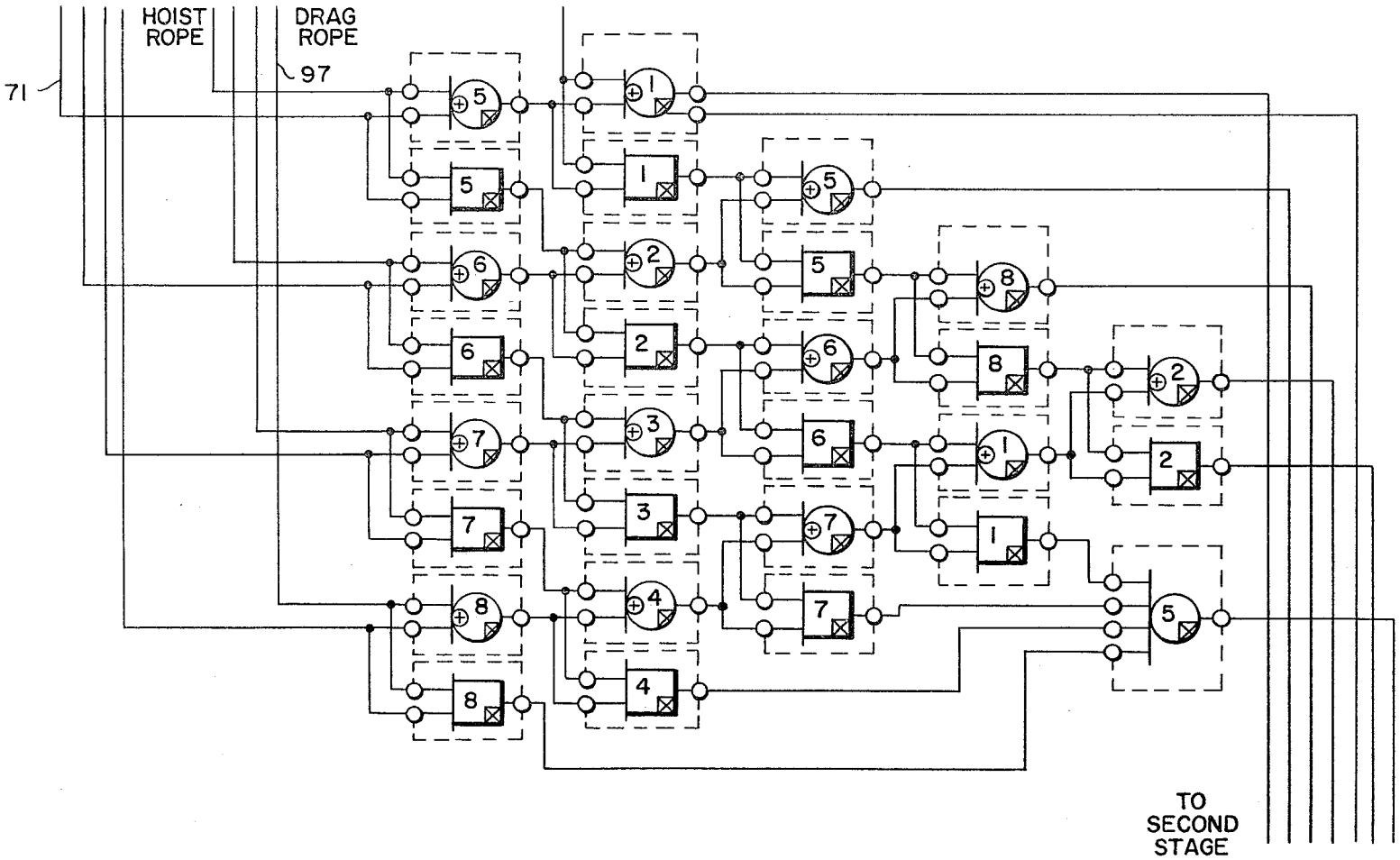
FIG. 11 is a detailed schematic diagram of the first-stage, most significant digit portion of the adder circuit in the FIG. 2 embodiment.
Figure 12:
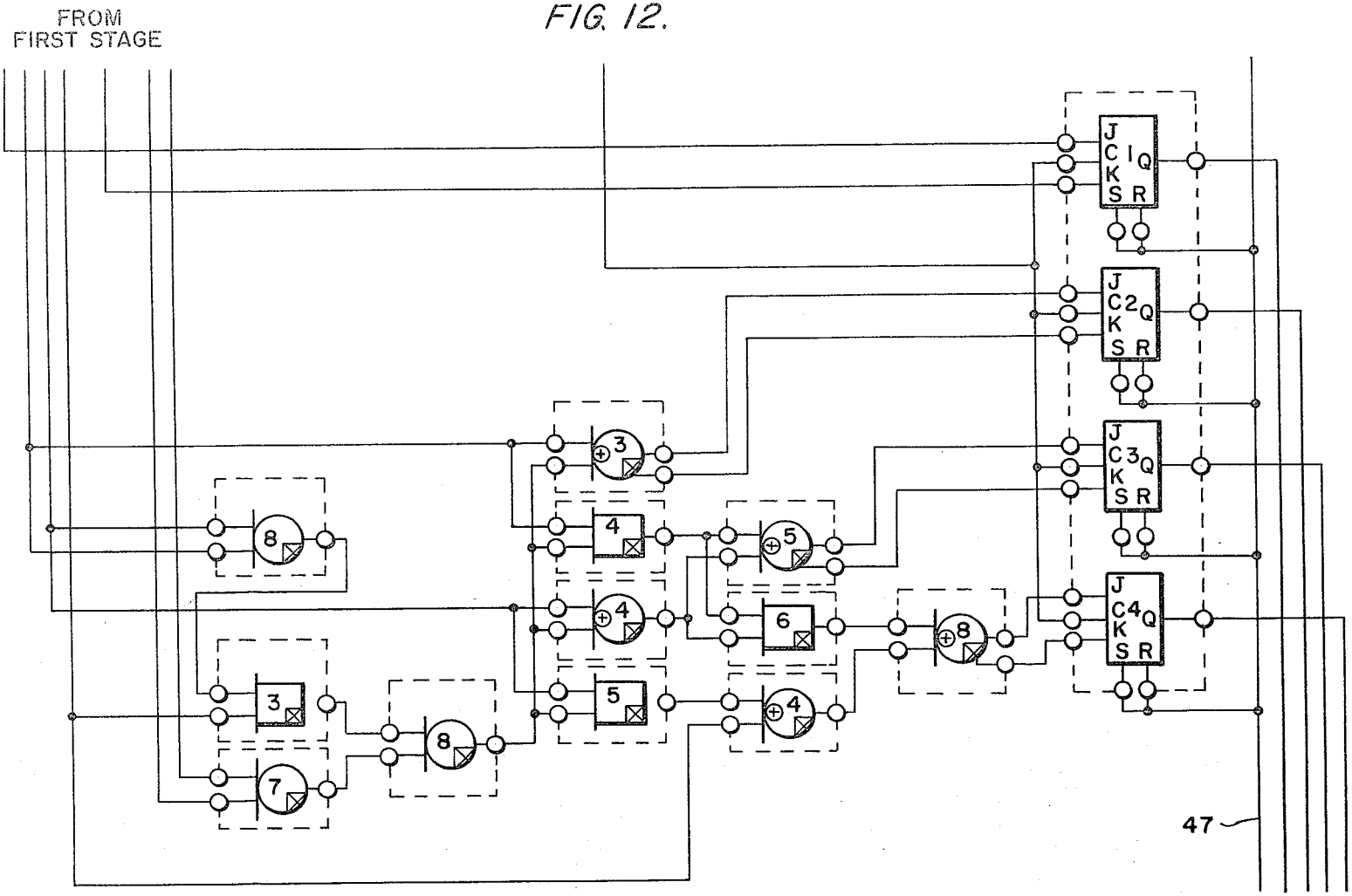
FIG. 12 is a detailed schematic diagram of the second-stage, most significant digit portion of the adder circuit in the FIG. 2 embodiment.

FIGS. 7 through 12, connected as shown, constitute a full and detailed schematic diagram of three-digit adder 46 in the FIG. 2 embodiment. As stated hereinabove, the function of this adder circuit is to logically add the values of the hoist rope and drag rope BCD signals from optical encoders 40*a* and 40*b*. FIGS. 7 and 8 constitute the complete two-stage adder circuit for the least significant digits of the hoist and drag rope position signals, FIGS. 9 and 10 constitute the complete second digit adder circuit for the same signals and FIGS. 11 and 12 constitute the full most significant digit adder circuit for these signals.

The adder circuit, in its entirety, constructed as shown, is a conventional digital adder circuit, a detailed description of the construction and operation of which need not be given herein. Logic circuits of the type shown and connected as shown will produce the added result mentioned above. Further, any other type of conventional digital logic circuit capable of adding BCD signals is considered suitable for this purpose.

The hoist rope and drag rope BCD input signals from the input circuits appear at lines 71 and 97, respectively, and the output from this circuit appears on the lines constituting the TR signal output 47 line from adder 46.

Figure 13:
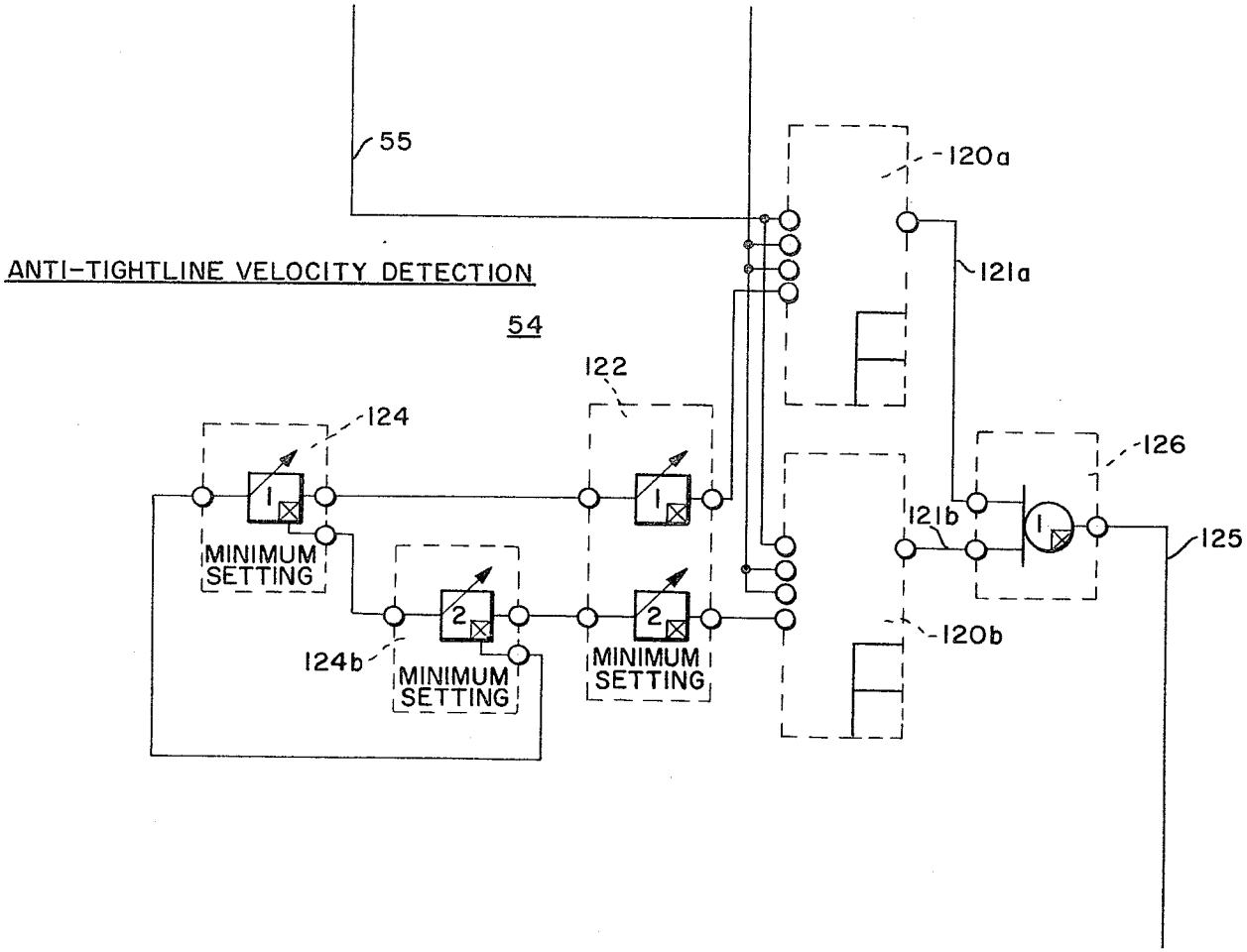
FIG. 13 is a detailed schematic diagram of the velocity detection circuit in the FIG. 2 embodiment.

In addition, data signals corresponding with the least significant digit appear on the lines constituting output line 55 (FIG. 8), and this information is communicated to velocity detection circuit 54 illustrated in FIG. 13.

In this figure, the least significant digit signal on line 55 is communicated in parallel to counter-timer circuits 120*a* and 120*b* connected as shown. These circuits are formed from Westinghouse type NL360T counter-timers, and each of them has an internal clock. Each counter-timer has a digit handling capability of two digits.

A timer module 122 connected to counter-timer circuits 120*a* and 120*b*, as shown, provides a minimum setting for the counter-timers. This minimum setting circuit is formed by a dual adjustable single shot timer module formed from a Westinghouse type NL350L circuit. Further, a pair of like circuits 124*a* and 124*b*, connected as shown, form a maximum setting control for the counter-timers.

The outputs from counter-timers 120*a* and 120*b*, which occur only when the preselected velocity limit is exceeded, are coupled via lines 121*a* and 121*b* to corresponding inputs of an OR gate 126, and the OR gate output on line 125 is a digital signal forming the velocity enable signal.

Figure 14:
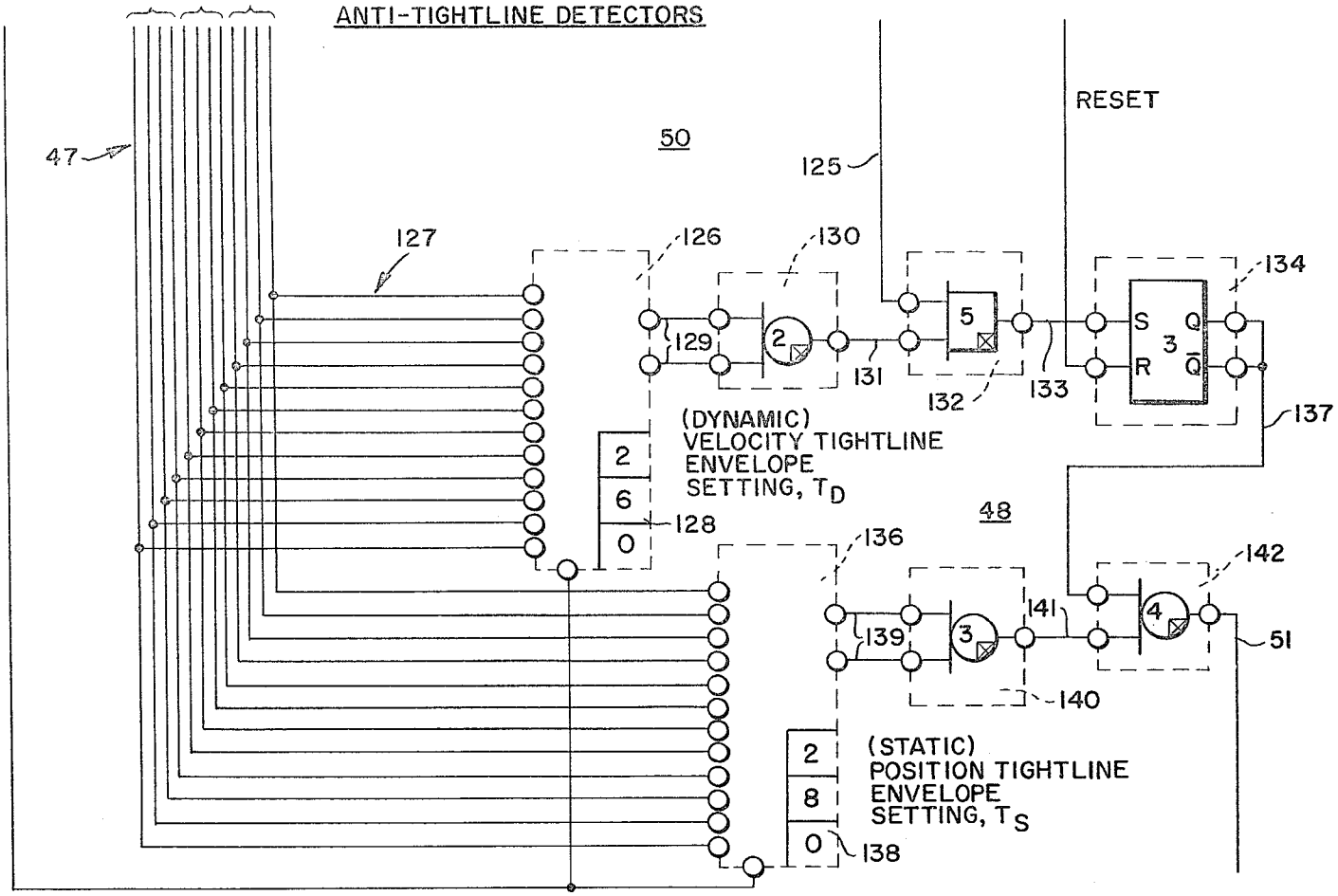
FIG. 14 is a detailed schematic diagram of the anti-tightline detector circuits in the FIG. 2 embodiment.

FIG. 14 is a detailed schematic diagram of the static tightline comparison circuit 48 and and the dynamic tightline comparison circuit 50.

The TR signal corresponding with the sum of the hoist and drag rope BCD input signals appears on lines 47 and is coupled to a comparator 126 via lines 127. The reference input to comparator 126 is supplied by thumb wheel operated digital input switch 128 which is set to a constant value calculated as discussed hereinabove. Comparator 126 is a Westinghouse type NL366 12-bit magnitude comparator circuit.

The output from the comparator circuit appearing on lines 129 is coupled to corresponding inputs of an OR gate 130. The output from this OR gate on line 131 is coupled to one corresponding input of an AND gate 132. The other input to the AND gate appears on line 125 which, it will be remembered, is the velocity enable signal. Therefore, an output will be produced from this AND gate on line 133 only if the velocity of the implement being monitored has exceeded a given value, and if the other conditions discussed herein are satisfied.

Any output appearing on line 133 is then supplied to flip-flop circuit 134 which is a Westinghouse type NL356L set-reset flip-flop. This produces an appropriate pulse signal on line 137 which is indicative of the presence or absence of a dynamic tightline condition. The line labeled reset communicates a reset signal to flip-flop circuit 134 which had previously been set by a tightline condition.

Lines 47 are also directly coupled to an input of comparator 126 which is likewise a Westinghouse type NL366 comparator circuit. The other input to this comparator circuit is received from thumb wheel operated digital input switches 138, and these switches are set to a reference value calculated in accordance with the instructions given hereinabove. Outputs indicative of the comparator result appear on lines 139 which are connected to corresponding input of an OR gate 140. The signal then appearing on the output 141 from OR gate 140 is indicative of the presence or absence of a static tightline condition.

The dynamic or static tightline signals on lines 137 and 141 are coupled through an OR gate 142 to line 51.

Figure 15:
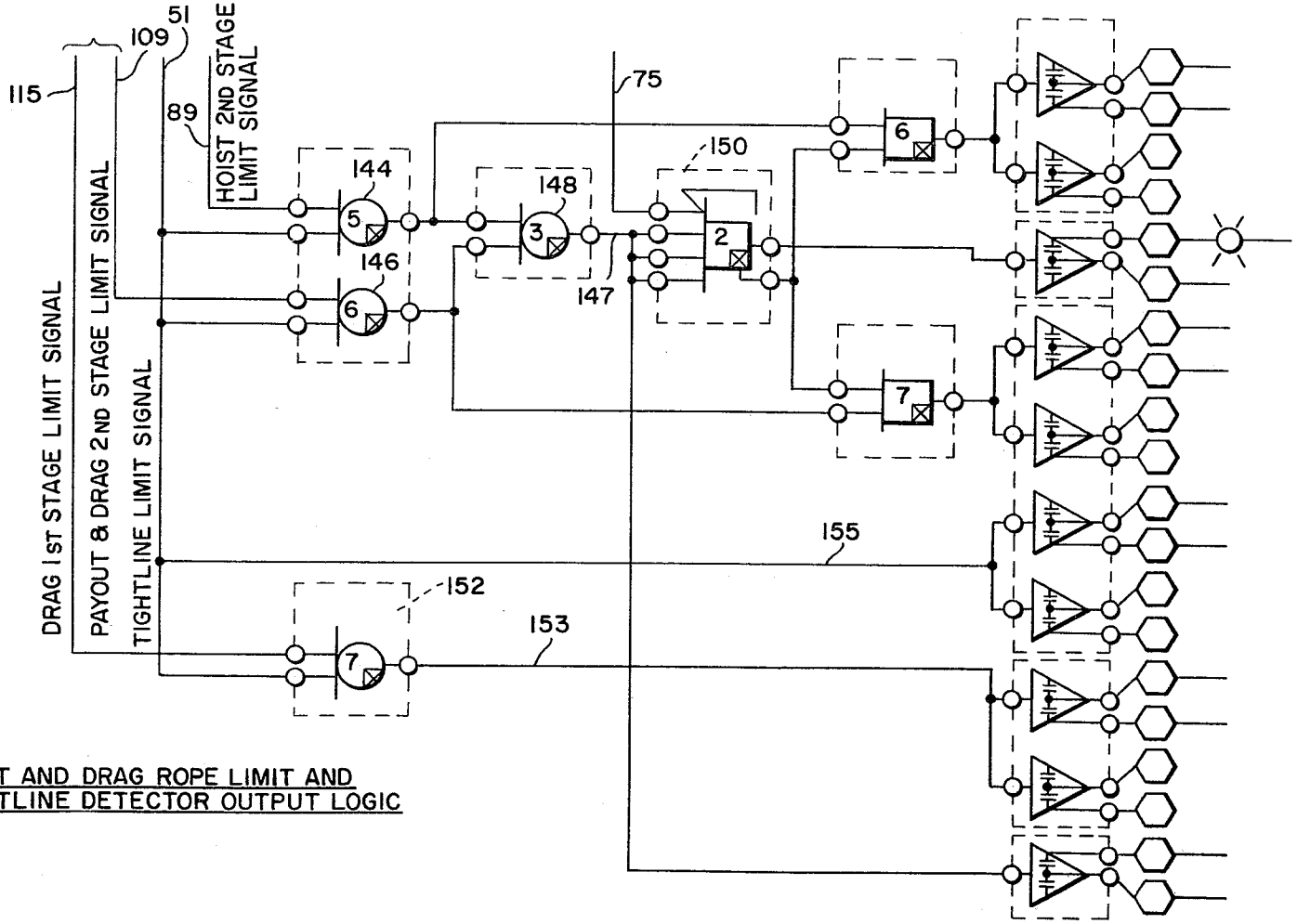
FIG. 15 is a detailed schematic diagram of hoist and drag rope limit and tightline detector output logic circuits which alternatively are used in conjunction with the FIG. 2 embodiment when the FIGS. 4 and 6 limit detectors are present.

FIG. 15 is a detailed schematic diagram of output logic circuitry which responds to the various limit and tightline indicating signals produced as described hereinabove. This output logic actuates various alarm functions as necessary to warn of tightline conditions or to indicate that the aforementioned hoist or drag limits have been exceeded. In addition, this logic provides the appropriate switching signals to initiate machine shutdown.

The tightline indicating signal appearing on line 51 from the FIG. 14 circuit and the hoist second-stage limit signal appearing on line 89 from the FIG. 4 circuit are, respectively, supplied to inputs of an OR gate 144. Likewise, tightline signal on line 51 and the pay-out and drag second-stage limit signal appearing on line 109 from the FIG. 6 circuit are applied to inputs of an OR gate 146. The outputs from OR gates 144 and 146 are supplied to a further OR gate 148.

The output from OR gate 148 appears on line 147 and supplies one of four inputs to AND gate 150. The latter AND gate is a Westinghouse type NL353L four input AND gate circuit. Two of the other inputs are connected in common to line 147. The remaining input receives the input signal which appears on line 75 discussed above.

An additional OR gate 152 receives at its inputs the drag first-stage limit signal appearing on line 115 and the tightline indicating signal appearing on line 51. The output from this OR gate on line 153 is coupled to output logic circuit 152.

The output logic circuit 152 is a series of Westinghouse type NL326L quad relay contact output signals which are capable of converting TTL levels to isolated contacts. These various contact outputs are arranged to receive the signals as indicated to provide the alarm or switch actuation functions which will affirmatively prevent the continuation of a tightline condition or the exceeding of hoist or drag limits. In addition to the direct appearance of the signal on line 153, logic circuit 152 receives the output of AND gate 150 via AND gates 154 and 156 in the illustrated connected arrangement. Further, the signal appearing on the tightline indicating line 51 is coupled directly to the logic circuitry via line 155.

Figure 16:
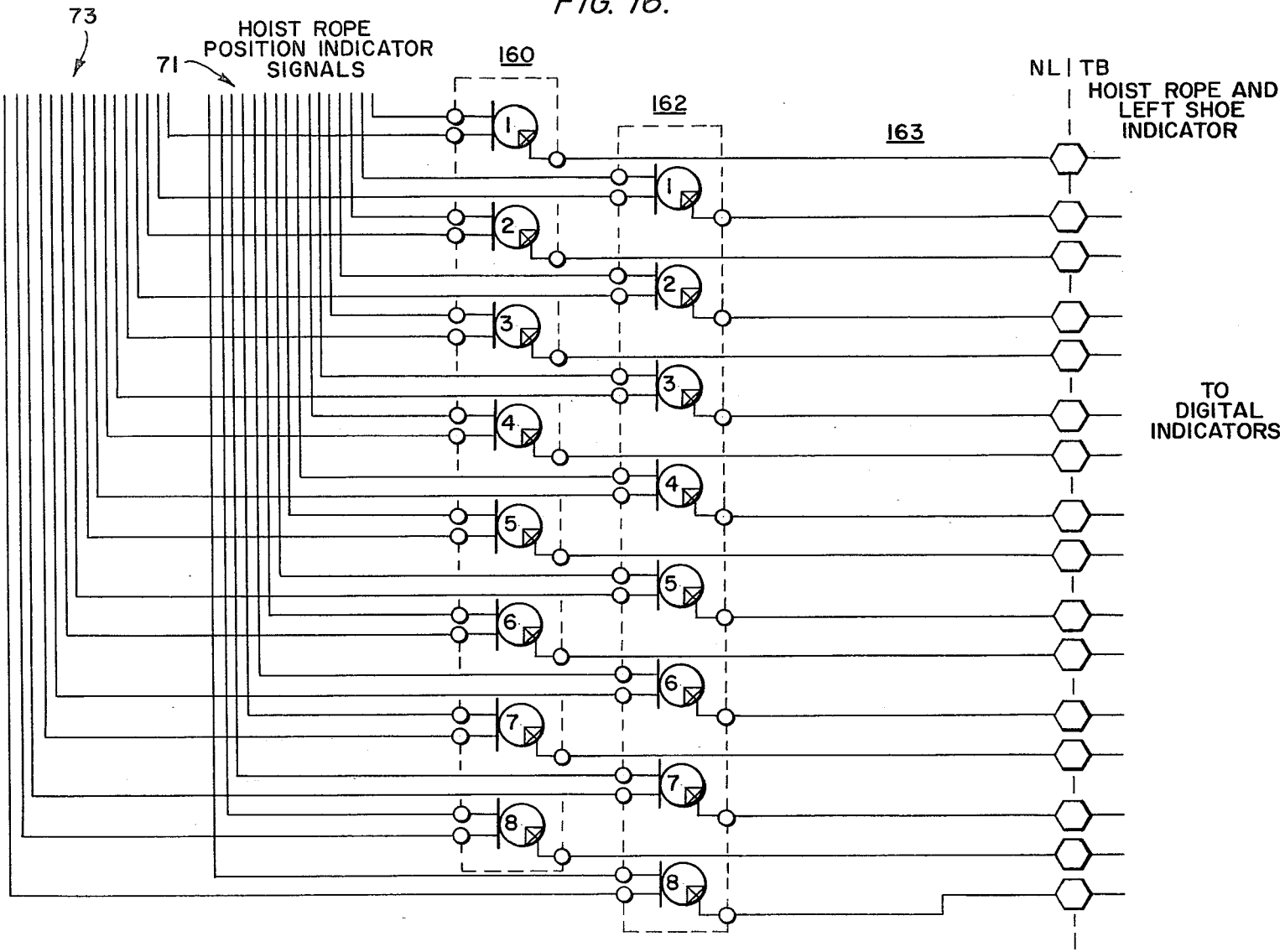
FIG. 16 is a detailed schematic diagram of hoist rope position indicator logic outputs from the FIG. 2 embodiment.
Figure 17:
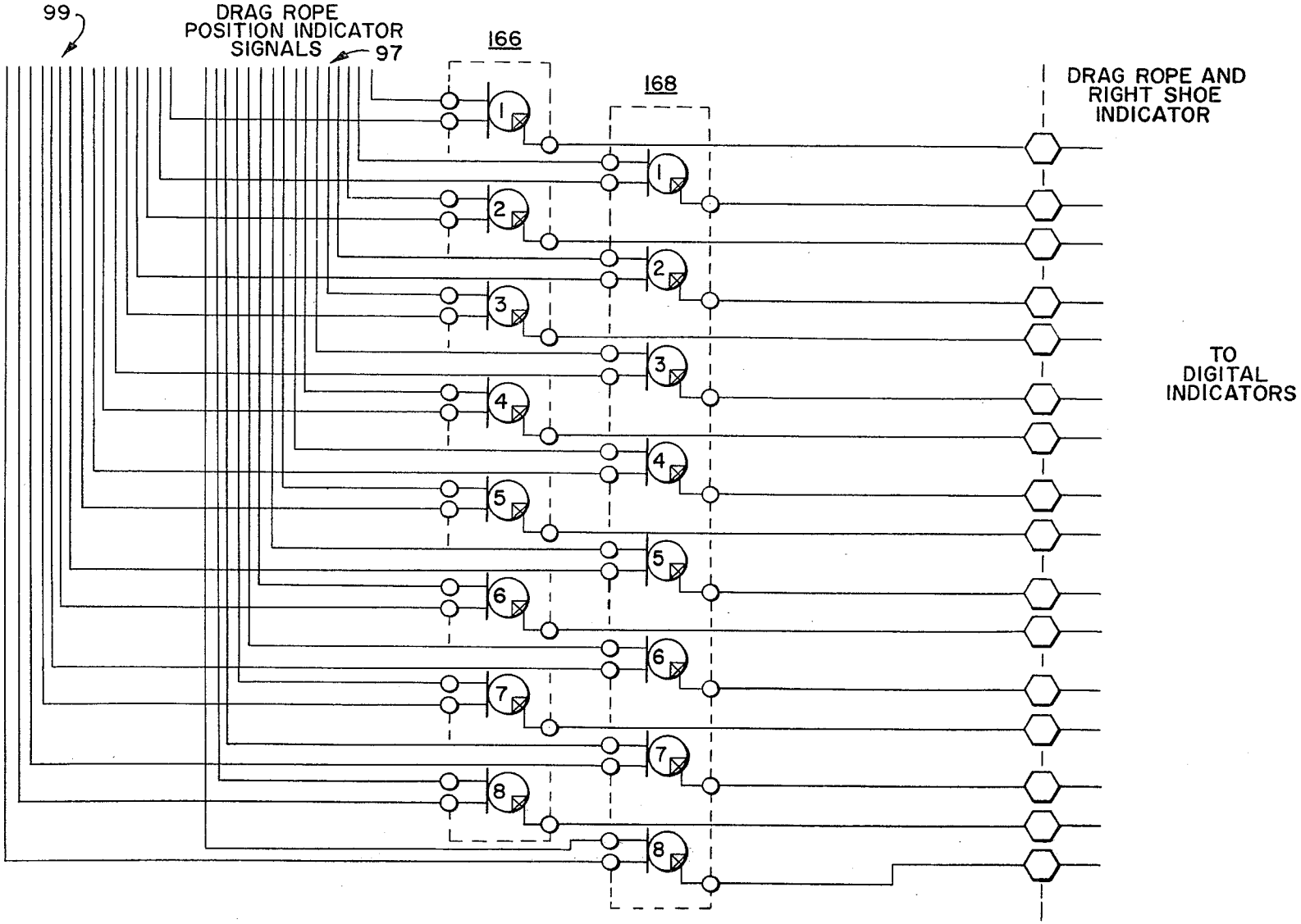
FIG. 17 is a detailed schematic diagram of drag rope indicator signal output logic from the FIG. 2 embodiment.

FIGS. 16 and 17 illustrate in detailed schematic form circuitry by which the hoist and drag rope BCD input signals are used to provide digital indications of the amount of rope paid out from the hoist and drag drums. The FIG. 16 circuit receives the hoist position indicator signals on lines 71, and the selecting signals from the input signal selection gates on lines 73 (see FIG. 3). These signals are communicated through OR gates 160 and 162 which, in this case, are used as inverters in order to permit interfacing with reverse (negative) logic. The output lines 163 are coupled to appropriate digital indicator circuitry.

FIG. 17 is a similarly constructed circuit which receives the drag rope indicating signals from lines 97 and the selection signals from gate circuits 96*a* and 96*b* (FIG. 5). These signals are communicated through OR gate circuits 166 and 168 to appropriate digital indicators.

In the apparatus described hereinabove, a technique has been described for providing dynamic and static tightline protection, as well as hoist and drag limit protection, without reliance upon drive system regulators and exciters. The technique used to establish the static and dynamic tightline parameters maintains maximum permissible operating capabilities while protecting against a tightline condition. The use of encoders, such as the described optical shaft encoders to provide information regarding operated implement position and velocity along with the described digital processing techniques provides optimum response time and accuracy in a hardware configuration which permits the monitoring of other parameters. For example, drum position indicators might be provided as described hereinabove or which indicate a number of revolutions of the drums. Additionally, the circuitry described can be arranged to utilize the foregoing drum data to provide a digging depth indication.

Using the technique according to the invention eliminates the use of bulky, inaccurate gear reducers, selsyn transmitters, potentiometers and other analog devices. Moreover, the inaccuracies and unreliable characteristics of such devices are removed.

The control analog described hereinabove can be readily calculated and supplied to operating personnel for adjustment of the circuit according to the invention in the field. Thus, the machine can readily be adjusted to accommodate changes in operating conditions while still providing the desired protection.

It is contemplated that the preferred embodiments of the invention described hereinabove are only exemplary of the principles of the invention. It is to be understood that the described embodiments can be modified or changed in ways known to those skilled in the art without deviating from the spirit and scope of the invention as defined in the appended claims.

I claim:

1. A method of preventing tightline condition in a dragline or the like, comprising the steps of:
- sensing the amount of hoist rope paid out from a hoist drum,
- sensing the amount of drag rope paid out by a drag drum,
- adding the values of the sensed amounts of drag and hoise rope paid out to produce a sum signal having a value corresponding to the sum of the values of hoist and drag rope paid out,
- comparing the value of said sum signal with a predetermined constant and
- halting dragline operation when the result of said comparing step is that said sum signal is of a value less than said predetermined constant.

2. The method defined in claim 1 further comprising the additional steps of:
- determining the velocity at which rope is paid out from said drums and producing a corresponding velocity signal,
- comparing said velocity signal with a predetermined velocity limit value and producing a velocity enable signal when said velocity signal exceeds in value said velocity limit value,
- comparing said sum signal with a second predetermined constant upon the appearance of said velocity enable signal to produce a dynamic tightline output signal if said sum signal is less than or equal to said second predetermined constant and
- halting dragline operation upon appearance of said dynamic tightline output signal.

3. The method defined in claims 1 or 2 wherein said sensing steps comprise sensing, respectively, the number of revolutions of said hoist and drag drums.

4. The method defined in claim 3 wherein said numbers of revolutions are optically sensed.

5. Apparatus for determining the existence of given operating conditions in a dragline or the like, comprising:
- first means for sensing the amount of hoist rope paid out from a hoist drum and producing a first sensing signal having a value corresponding thereto,
- second means for sensing the amount of drag rope paid out from a drag drum and for producing a second sensing signal having a value corresponding thereto,
- adder means for producing a sum signal having a value corresponding to the added values of said first and second sensing signals,
- detector means for producing a velocity signal having a value corresponding to the rate at which rope is paid out from said drums,
- first comparator means for producing a velocity enable signal when said velocity signal equals a predetermined value,
- second comparator means for comparing said sum signal and a first predetermined constant when enabled by said velocity enable signal to produce a first comparator output signal when said sum signal is less than or equal to said first predetermined constant,
- third comparator means for comparing said sum signal and a second predetermined constant for producing a third comparator output signal when said sum signal is equal to or less than said second predetermined constant, and
- switch means actuated by either of said second or third comparator output signals indicating the presence of a dynamic or static tightline condition.

6. The apparatus defined in claim 5 wherein said first and second sensing means produce said first and second sensing signals in accordance with the number of revolutions of said hoist and drag drums.

7. The apparatus defined in claim 6 wherein said first and second sensing means optically sense the number of revolutions of said hoist and drag drums.

8. The apparatus defined in claim 5 further comprising fourth comparator means for comparing said first sensing signal with a value corresponding with a predetermined value of hoist rope to be paid out from said hoist drum and for producing a fourth comparator output signal indicating amount of said hoist rope paid out.

9. The apparatus defined in claim 5 further comprising a fifth comparator means for comparing said second sensing signal with a predetermined value of drag rope to be paid out from said drag drum and for producing a fifth comparator output signal indicating the amount of said drag rope paid out.

* * * * *